US006339298B1

(12) United States Patent
Chen

(10) Patent No.: US 6,339,298 B1
(45) Date of Patent: Jan. 15, 2002

(54) DIMMING BALLAST RESONANT FEEDBACK CIRCUIT

(75) Inventor: Timothy Chen, Germantown, TN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/571,630

(22) Filed: May 15, 2000

(51) Int. Cl.[7] ..... H05B 37/02

(52) U.S. Cl. ..... 315/224; 315/DIG. 4; 315/247; 315/307

(58) Field of Search ..... 315/DIG. 4, 225, 315/224, 244, 247, 307, 308, 291, DIG. 5

(56) References Cited

U.S. PATENT DOCUMENTS

| | | | | |
|---|---|---|---|---|
| 5,691,605 A | * | 11/1997 | Xia et al. | 315/307 |
| 5,872,429 A | * | 2/1999 | Xia et al. | 315/194 |
| 6,020,689 A | * | 2/2000 | Gradzki et al. | 315/224 |
| 6,051,936 A | | 4/2000 | Qian | 315/224 |
| 6,100,647 A | * | 8/2000 | Giannopoulos et al. | 315/224 |
| 6,211,623 B1 | * | 4/2001 | Wihelm et al. | 315/224 |

* cited by examiner

*Primary Examiner*—Don Wong
*Assistant Examiner*—Ephrem Alemu
(74) *Attorney, Agent, or Firm*—Fay, Sharpe, Fagan, Minnich & McKee, LLP

(57) ABSTRACT

A dimming ballast circuit suitable for use with a phase dimmer has a switching network 70 consisting of a complimentary pair of switches 32, 34 which are driven by a low-power universally available controller IC 72. The controller IC 72 is configured with a floating ground arrangement 78. A current sensor 112 assists in generating a positive feedback signal 110 which is provided to an inverting input of operational amplifier 152 of compensation network circuit 62. A level shifted phase dimmer signal is generated by a level shifting circuit 60 and the error difference between the positive feedback signal 110 and the level shifted signal is amplified by operational amplifier 152 to, in turn, control the output frequency of controller IC 72. The level shifting circuit 60 shifts the dimming signal 68 from a ground reference system to a floating ground design. A resonant feedback circuit 18 includes capacitors 42 and 56 that couple energy from a resonant load 14 back to the input dimming signal 68 for the purpose of providing a continuous load to the phase dimmer and damping for an input EMI filter 220.

20 Claims, 2 Drawing Sheets

DIMMING BALLAST RESONANT FEEDBACK CIRCUIT

FIELD OF INVENTION

The present invention relates to a ballast, or power supply circuit, for gas discharge lamps of the type using regenerative gate-drive circuitry to control a pair of serially connected, complementary conduction-type switches of a d.c.-a.c. inverter. More particularly, the invention relates to a resonant feedback circuit drawing continuous input current to satisfy requirements of phase control dimmers.

BACKGROUND OF THE INVENTION

Phase-controlled dimmable ballasts have gained a growing popularity in industry due to their capability for use with photo cells, motion detectors and standard wall dimmers.

Dimming of fluorescent lamps with class D converters is accomplished by either regulating the lamp current, or regulating the average current feeding the inverter. For cold cathode fluorescent lamps (CCFLs), the pulse width modulating (PWM) technique is commonly used to expand a dimming range. The technique pulses the CCFLs at full rated lamp current thereby modulating intensity by varying the percentage of time the lamp is operating at full-rated current. Such a system can operate with a closed loop or an open loop system The technique is simple, low cost, and a fixed frequency operation, however, it is not easily adapted to hot cathode fluorescent lamps. For proper dimming of hot cathode lamps, the cathode heating needs to be increased, as light intensity is reduced. If inadequate heating exists, cathode sputtering increases as the lamp is dimmed. Also, the lamp arc crest factor should be less than 1.7 for most dimming ranges, in order to maintain the rated lamp life. The higher the crest factor, the shorter will be the life of the lamp. The PWM method does not address these problems, and therefore so far has been limited to CCFL applications.

Class D inverter topology with variable frequency dimming has been widely accepted by the lighting industry for use in the preheat, ignition and dimming of a lamp. The benefits of such a topology include, but are not limited to (i) ease of implementing programmable starting sequences which extend lamp life; (ii) simplification of lamp network design; (iii) low cost to increase lamp cathode heating as the lamp is dimmed; (iv) obtainable low lamp arc crest factor; (v) ease of regulating the lamp power by either regulating the lamp current or the average current feeding the inverter; and (vi) zero voltage switching can be maintained by operating the switching frequency above the resonant frequency of the inverter.

Conventional class D circuits which are used for d.c.-to-d.c. converters or electronic ballasts, implement a two-pole active switch via two, n-channel devices or n-p-channel complementary pairs. A gate is voltage controllable from a control-integrated circuit (IC), which is normally referenced to ground, thus, the control signals have to be level shifted to the source of the high-side power device, which, in class D applications, swings between two rails of the circuit. The techniques presently used to perform this function are by either, transformer coupling or a high-voltage integrated circuit (HVIC) with a boot-strapped, high side driver. Either solution imposes a severe cost and performance penalty.

For transformer coupling, the transformer needs to have at least three isolated windings wound on a single core, adding to cost and space considerations. The windings need to be properly isolated to prevent breakdown due to the presence of high potential. Also, the gate's drive circuit needs to be damped and clamped to prevent ringing between leakage inductors of the transformer and parasitic capacitors of switching MOSFETs.

In the case of high-voltage integrated circuits (HVIC), the HVIC has two isolated output buffers and logic circuitry which is sensitive to negative transients. The high-voltage process for the IC increases the size of the silicon die, and the boot-strap components add to the part count and costs. Such a system is also severely limited as to the switching frequency obtainable, which commonly is less than 100K Hz. Consequently, it uses the large sizes of EMI filters and resonant components and requires larger space for implementation.

In incandescent lamp dimming systems, dimming is controlled by a phase dimmer, also known as a triac dimmer. A common type of phase dimmer, blocks a portion of each positive or negative half cycle immediately after the zero crossing of the voltage. The clipped waveform carries both the power and dimming signal to the loads. The dimmer replaces a wall switch which is installed in series with a power line.

It would be desirable to use existing phase dimmer signals for dimming of compact fluorescent lamps (CFL). A system designed to use existing triac phase dimmers must satisfy the requirements of the triac, one of which is a holding current specification. When the triac is in a conducting state, the current through the triac must remain above the specified holding current in order for the triac not to switch off and interrupt current. It would also be desirable to have such a system use a single-stage design for dimming and interfacing with a phase dimmer, provided at a low cost, with a direct gate drive for both high and low side MOSFET switches, with minimal voltage and current stresses on a resonant circuit. Still a further desirable aspect is to have a circuit which would allow programmable starting sequences to extend a lamp life, allow for low lamp arc crest factors and zero voltage switching over wide ranges. Such a system should also include compact size with low component counts and be easily adapted for different line input voltage and powers and provide for adequate protection for abnormal operations.

SUMMARY OF THE INVENTION

In an embodiment of the present invention, a dimmable ballast circuit is designed to receive a phase dimmer signal to control output of a fluorescent lamp. The dimming ballast includes an input section configured to receive the phase dimmer signal. The system includes a low cost integrated chip having an internal operational amplifier with a non-inverting input tied to a steady-state input within the integrated chip for a totem pole output. The IC is also configured in a floating ground arrangement with the floating ground connected to the inverting input of the operational amplifier. A coupling capacitor is connected at one end of the output of the controller IC. A switching network is designed with a pair of complementary connected switches, and is also connected to receive the output from the IC through a second end of the coupling capacitor. A current-sensing resistor is used to sense the switching current of a power switch in order to generate a feedback signal. A level shifter is designed to receive a signal from the input section, and to shift the received signal from a level of the reference ground to a level of the floating ground, the error difference between level shifted signal and the feedback signal are amplified by a separate operational amplifier not part of the IC, and the amplified signal is supplied to the frequency control input of the integrated chip. In this manner the output frequency of the integrated chip regulates the output intensity of the lamp.

DETAILED DESCRIPTION OF THE INVENTION

Figure 1:
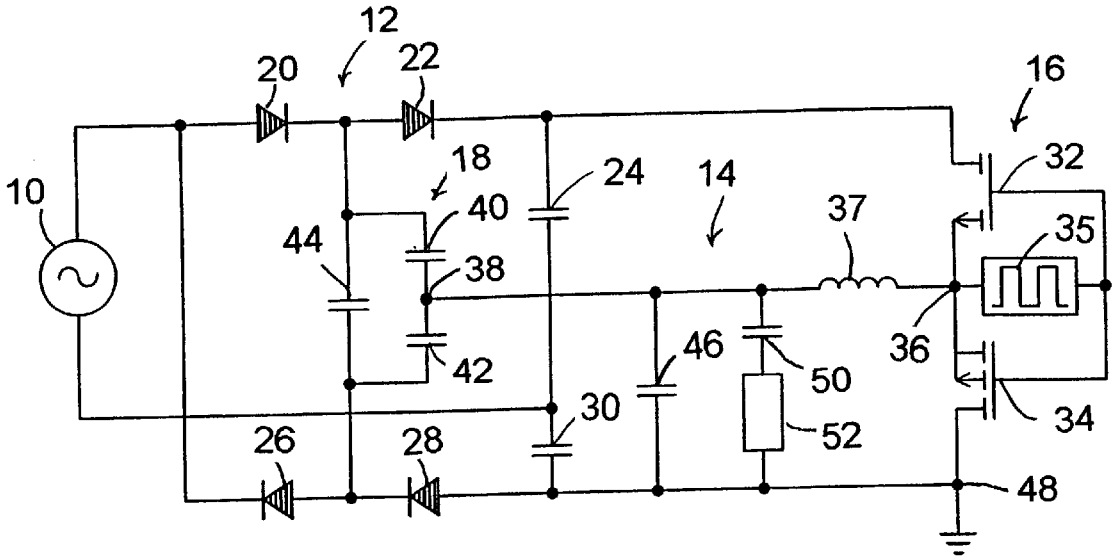
FIG. 1 is a simplified schematic illustrating the concept of resonant feedback.

FIG. 1 shows a partial schematic of a ballast dimmer circuit employing a first embodiment of the present invention. Shown in FIG. 1 are: a phase dimmer input or source 10, an input network 12, a resonant circuit load 14, complementary conduction-type switches 16 and resonant feedback circuit 18. Omitted from FIG. 1 for the sake of simplicity are an EMI filter (220 in FIG. 3), a level shifting circuit (60 in FIG. 3), a compensation network (62 in FIG. 3), a controller integrated circuit (64 in FIG. 3) and a load sensing circuit (112 in FIG. 3).

Positive going signals from phase dimmer source 10 are rectified through first and second diodes 20 and 22 connected in series with capacitor 24 whose remaining lead is connected to the remaining phase dimmer source 10. Negative going signals from phase dimmer source 10 are rectified through third and fourth diodes 26 and 28 connected in series with capacitor 30 whose remaining lead is connected to the remaining phase dimmer source 10 input lead which places capacitors 24 and 30 in a series voltage-doubler arrangement. Complementary FET switches 32 and 34 are connected in a common source arrangement across voltage-doubling capacitors 24 and 30. The gates of switches 32 and 34 are connected to common drive signal 35 that is, in turn, connected to common source node 36. Drive signal 35 is a variable frequency, square wave drive signal, alternately positive and then negative with respect to common source node 36.

Resonant inductor 37 is connected to the common source leads of switches 32 and 34 and to node 38 which is a common connection node of resonant capacitors 40 and 42. Resonant capacitor 40, is in turn connected to the junction between diodes 20 and 22 and second resonant feedback capacitor 42 is connected at the junction of diodes 26 and 28. Capacitor 44 is connected between the two aforementioned diode junctions so that it is bridging capacitors 40 and 42. Resonant load capacitor 46 is connected between node 38 and the anode lead of diode 28 which also serves as ground node 48. The load being powered by resonant load circuit 14 comprises capacitor 50 connected in series with lamp 52 between nodes 38 and 48.

The described circuit is especially beneficial for an electronic ballast or phase dimmer circuit, such as a triac dimmer, employing an EMI filter. It is known that if an EMI filter included with the electronic ballast or the phase dimmer is not properly loaded, there is a danger it could misfire the dimmer causing the lamp to flicker. The just described circuit acts to continue loading the EMI circuit and eliminate lamp flicker even at low conduction angles.

Figure 3:
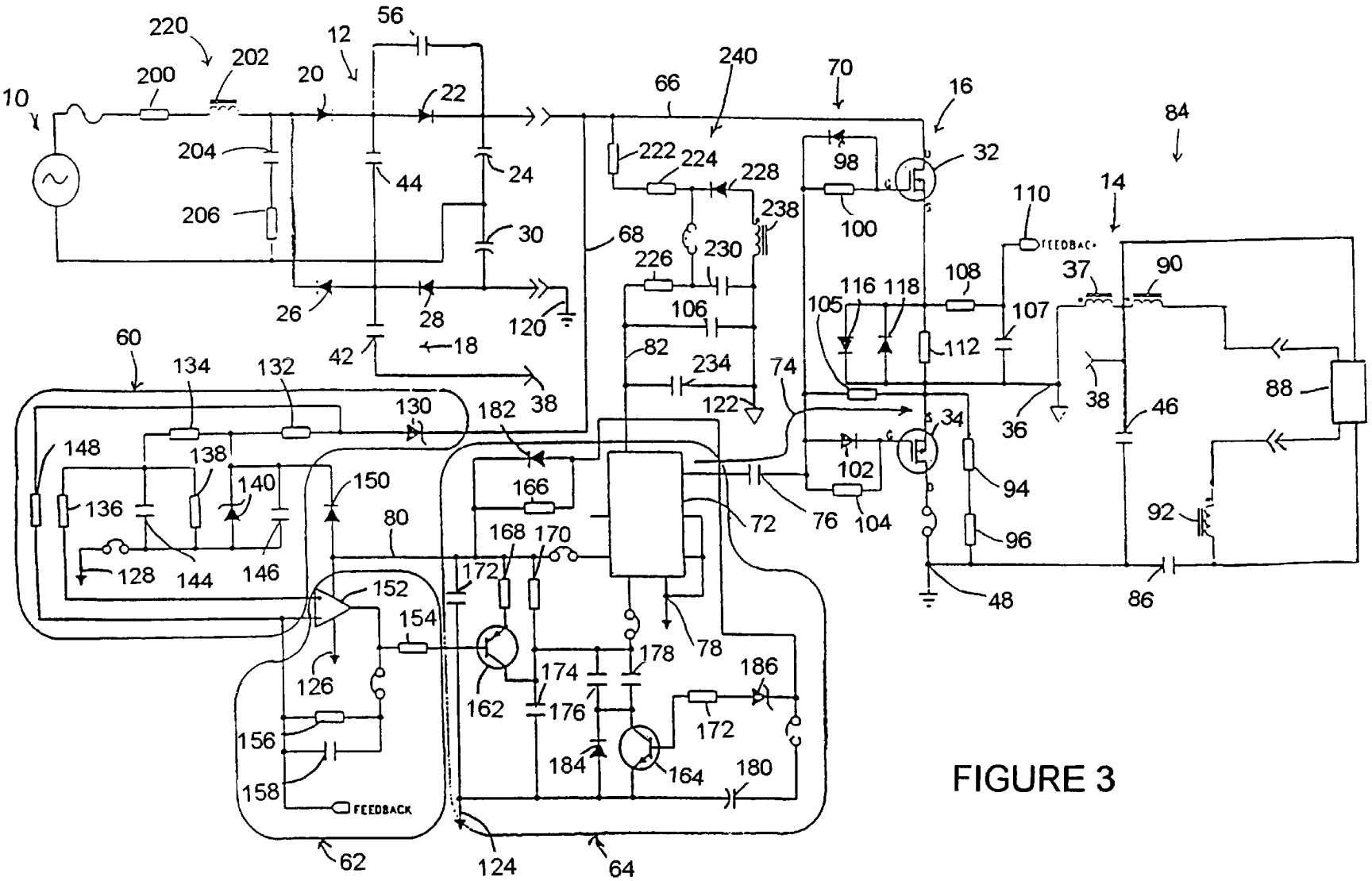
FIG. 3 is a detailed schematic of one embodiment of the present invention.

Since the purpose of this discussion is to explain the functioning of resonant feedback circuit 18, explanation of a complete ballast dimming circuit will be deferred until later when FIG. 3 is explained. For the purposes of this discussion it can be assumed, as described above, that square wave signal 35 is connected between common source node 36 and the common gate connections of switches 32 and 34 thus causing common source node 36 to be alternately switched between ground potential at node 48 and the full DC potential at the cathode of diode 22. Under steady-state operation, it can also be assumed that capacitors 24 and 30 have acquired a fall working charge and that resonant load circuit 14 has stored energy in resonant inductor 37 and resonant capacitor 46. Under these conditions, because the switching frequency at node 36 is many times the frequency of phase dimmer source 10, without a feedback circuit or other special circuits, current load on the phase dimmer would fall below the minimum holding current for the phase dimmer triac causing the triac to switch off prematurely. Resonant feedback capacitors 40 and 42 provide an economical design for exchanging energy between resonant load circuit 14 and input network 12 so that current drawn from phase dimmer source 10 does not fall below its minimum holding current at any time within the conduction phase of the dimmer's triac.

While the circuit of FIG. 1 is effective in meeting minimum input holding current requirements, still further improvements are possible in terms of minimizing the lamp current crest factor. To understand how an improvement in crest factor is possible, it is necessary to understand the effect of feedback capacitors 40 and 42 on the resonant load circuit 14. This can best be accomplished by presenting an equivalent input capacitance approximation given by $$C_{eq}=(C_{40}+C_{42})(|v_{in}|+2V_a-V_{dc1})/2V_a \quad (1)$$

where $v_{in}$ is the phase dimmer source 10 input voltage, $V_a$ is the peak AC voltage on resonant capacitor 46, $v_{dc1}$ is the voltage on capacitor 24, $C_{40}$ is capacitor 40 and $C_{42}$ is capacitor 42. It can be seen from Equation (1) that $C_{eq}$ is highly dependent on the magnitude of the phase dimmer input voltage, and, due to the effect of $C_{eq}$, the total resonant capacitance ($C_{eq}$+capacitor 46) varies with the input voltage. As a result, the crest factor of the lamp current can be higher than desirable. The chopped nature of the line waveform from a phase dimmer makes the problem even more pronounced.

Figure 2:
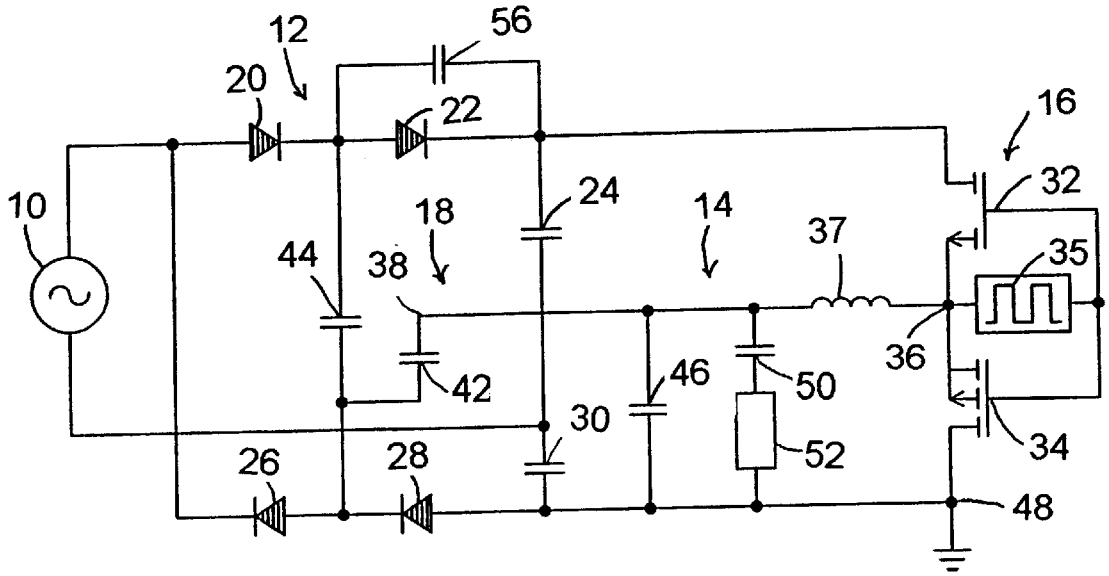
FIG. 2 is an improved version of the schematic depicted in FIG. 1.

FIG. 2 shows a second embodiment of the present invention with an improved circuit in terms of lamp current crest factor. The second embodiment is similar to that in FIG. 1, and like numbered components in FIG. 2 serve the same purpose in both figures. Resonant feedback capacitor 40 in FIG. 1 has been removed in FIG. 2, and resonant feedback capacitor 56 has been added in FIG. 2, in parallel with diode 22. By properly selecting $C_{56}$ and $C_{42}$, the variation of $C_{eq}$ will be minimized, thus minimizing the effects of resonant feedback capacitors $C_{56}$ and $C_{42}$ on the resonant tank 14 and on the lamp crest factor.

Turning now to FIG. 3, illustrated is a more complete schematic incorporating the improvements shown in FIG. 2 into a floating IC driven ballast. Like numbered numerals in FIGS. 2 and 3 identify components serving identical purposes. Since like numbered components in FIG. 3 function exactly as described for FIG. 2, their function will not be described again in the following discussion. Similarly, since the finctioning of level shifting circuits, compensation networks and controller IC circuits like level shifting circuit 60, compensation network 62 and controller IC circuit 64 are well understood in the art, they will not be described in detail here. Their function will, however, be described sufficiently to understand their interaction with the concepts of the present invention.

Input phase dimmer voltage source 10 generates a bus voltage 66, and a phase dimmer signal 68. Node 48 serves as ground reference for the ballast circuit. Bus voltage 66 is provided to a switching network 70, and phase dimmer signal 68 is provided to level shifting circuit 60 having a floating ground reference comprising common source node 36. A controller integrated circuit (IC) 72, such as a current mode pulse width modulated (PWM) controller IC, delivers a gate drive 74 to switches 32 and 34 through the coupling capacitor 76. In the present embodiment switches 32, 34 may be configured as a complementary pair of MOSFETs, with switch 32 being an n-channel MOSFET and switch 34 being a p-channel MOSFET. Controller IC 72 is configured with a floating ground 78, corresponding to node 36, and is supplied with a compensation network 62, and IC 72 supplies a reference voltage 80. The IC 72 is powered by a signal from a voltage source 82. Phase dimmer signal 68 is therefore a chopped input voltage which is shifted from circuit ground to a floating signal ground.

Switching network 70 delivers signals to a load circuit 84 having a series resonant configuration including resonant inductor 37 in series with resonant capacitor 46. A matching capacitor 86 is provided for low bus applications in order to maintain sufficient voltage as lamp 88 is dimmed, with the lamp cathodes heating being powered through windings 90 and 92. Lamp 88 may, in one embodiment, be a compact fluorescent lamp.

Resistors 94 and 96 work in conjunction with voltage source 82 in order to ensure proper start-up of controller IC 72. The parallel combinations of diode 98, resistor 100 and diode 102, resistor 104 provides sufficient dead time to complementary switches 32 and 34, respectively. Resistor 105 works in conjunction with capacitor 76 to convert the pulse DC output of the IC 72 to an AC square waveform through diode 98, resistors 100, 104, and diode 102 in order to drive the switches 32 and 34. Resistor 105 is important because it provides the initial charging of capacitor 72, and, therefore, determines the initial time delay until a transition to normal switching of switches 32 and 34 occurs. When the circuit is first activated, only switch 32 will be biased to the on state because the output on pin 6 of integrated circuit 72 is always positive with respect to floating ground at nodes 78 and 36. As capacitor 72 charges, the current through resistor 105 will transition gradually from a current substantially in one direction to an alternating square wave current. At this time switches 32 and 34 will be alternately switched on and off. This transition must occur before capacitor 106 loses much of its initial charge because capacitor 106 is the initial source of energy for powering integrated circuit 72. If, for example, capacitor 106 is initially charged to 16 volts, transition to normal switching of switches 32 and 34 must occur before the charge on capacitor 106 falls below 9 volts. Additional details on the source of power for integrated circuit 72 are discussed later.

The network of capacitor 107 and resistor 108 function as a low pass filter to provide an average current feedback signal 110, based on the output of current sense resistor 112, so as to provide current feedback signal 110 to compensation network 62. Current sense resistor 112 has parallel diodes 116 and 118 connected across it in opposite directions to limit the voltage drop across it to not more than 0.7 volts. In this way switches 32 and 34 are always operated in the saturation region and are protected from operating in the linear region during startup which can cause overheating and failure of the switches.

Switching network 70 has a common to ground 48, and the point between switch 32 and switch 34 nearest switch 34 is at floating ground 36.

Whereas the potential of circuit ground such as circuit grounds 48 and 120 are unchanging, the potential of a floating ground, such as that comprising nodes 36, 78, 122, 124, 126 and 128, are constantly changing with reference to the circuit grounds. Thus, when switch 34 is turned on, floating ground 36 will be moved to circuit ground. However, when switch 32 is turned on, floating ground 36 will become substantially equivalent to the bus voltage value 66. Further, since the floating ground nodes are tied together, controller IC 72 also varies between these levels.

Use of the floating ground configuration allows the use of a low voltage IC, such as a 35-volt IC instead of a more expensive high-voltage IC. Also, by implementing the low-voltage IC, a transformer coupling the gate drives is not necessary. Further, using the floating ground IC technique, it is possible to drive the ballast circuit into the megahertz range since power dissipation on the IC is extremely low compared to high-voltage techniques.

A challenge faced when implementing the present design of using a floating ground reference for controller IC 72, is a manner of desirably delivering dimming signal 68 to controller IC 72. This is a challenge since the floating ground value swings from ground reference to substantially the bus voltage input. In the present invention, dimming signal 68 is provided to controller IC 72 through level shifter circuit 60, which is provided with a floating ground 126, tied to the floating ground 78 of controller IC 72. By this arrangement, a signal provided from the rectified input dimmer voltage source 10, which is tied to circuit ground 120, may—as shown in level shifter circuit 60—be shifted through Zener diode 130, resistors 132, 134, 136 and Zener diode 140. Capacitors 144 and 146 and resister 148 also comprise a portion of the level shifting circuit. Diode 150 is connected between zener diode 140 and capacitor 146 at one end, and to operational amplifier 152 at its other end.

The present invention further uses a current sensing technique to provide the desired output under the constraints of controller IC 72. In particular, current sensing resistor 112 is used to obtain actual lamp system power. Capacitor 107 and resistor 108 provide the average value of the switching current when the bus voltage is fixed. Using an average value of the bus voltage times the average value of switching current, the system power can be controlled and therefore also, the lamp lumen output. It is noted that the average current of the system is that detected through resistor 108, and obtaining the average value of the bus voltage may be achieved by various known techniques. By lowering system power, light output of lamp 88 will be lowered and by increasing system power light output of lamp 88 is increased.

Using the floating ground system configuration of the present embodiment means feedback signal 110 will be a positive signal. Positive feedback signal 110 is fed to the inverting input of operational amplifier 152 of compensation network 62. Compensation network 62 further comprises resistors 154 and 156, capacitor 158. The non-inverting input of operational amplifier 152 receives its input through resistor 148 of level shifting circuit 60. The output of operational amplifier 152 is then provided to controller IC circuit 64 at the base terminal of transistor 162 which in turn varies the effective resistance of the timing resistor connected between pins 8 and 4 of the controller IC 72. Controller IC circuit 64 further includes transistor 164, resistors 166, 168, 170, capacitors 172, 174, 176, 178, 180, diodes 182, 184, Zener diode 186 and controller IC 72. Operation of this circuit acts to adjust the output frequency of controller IC 72 at pin 6 to coupling capacitor 76 and through resistor 105 to floating ground 36, and thereby maintain the lumen output at a given dimming level.

The present invention uses a complimentary pair of MOSFETs driven by controller IC 72 through a.c.-coupling capacitor 76 to operate lamp 88. The driving scheme eliminates the need for a high-side driver or a pulse transformer and/or generating a negative bias gate or other driving scheme.

A further mentioned concept of the present invention is the use of level-shifting circuit 60 which shifts chopped dimming signal 68, from a ground reference level of voltage source 10 to a floating ground signal. The shifting of this dimming signal 68 allows the input signal from level shifter 60 to be used by controller IC 76.

With attention to input section 12, phase dimmer source 10 is connected to supply resistive inductive components 200 and 202, respectively. An RC network comprised of capacitor 204 and resistor element 206 are placed across the inputs of the voltage doubling rectifier circuit which is comprised of diodes 20, 22, 26, 28 and capacitors 24 and 30. Capacitor 204 and resistor element 206 cooperate with inductor 202 to form an EMI filter 220. The rectified phase dimmer signal 68 is supplied to level shifter circuit 60 via Zener diode 130. Zener diode 130 is supplied to ensure appropriate voltage levels, especially in light of the voltage doubling rectifier circuit configuration.

Turning attention to the voltage source 82 which supplies voltage to controller IC 72 on pin 7, a network comprising resistors 222, 224 and 226, diode 228, capacitors 230, 106 and 234, and inductor 238 form a start-up circuit 240, to generate the necessary voltage for starting of controller IC 72. It is noted that once controller IC 72 is charged up to an operating voltage, controller IC 72 will consume more power than can be supplied by the described start-up circuit 240 through resistors 222 and 224. Therefore, further DC bias is provided by inductor 238. Inductors 37, 90, 92 and 238 all share the same core, poled as indicated by dots on the schematic in FIG. 3.

The above-described circuit provides a voltage-fed series resonant class D system with variable frequency, which is particularly applicable for use in compact fluorescent lamps. This topology allows easily operating in zero-voltage switching (ZVS) resonant mode, reduces the MOSFET switching losses and electrical magnetic interference. Further, by varying the switching frequency, it is possible to modulate the average current in the switching MOSFETs and therefore the output power.

The complementary pair of MOSFETs 32, 34 of the present embodiment are driven by a low-cost, single totem pole, class D, buffer output, such as a UC3844A or equivalent controller IC 72, through a.c. coupling capacitor 76. The cascade class D driving scheme eliminates the need for a high-voltage integrated chip (HVIC) or a pulse transformer and/or generating a negative gate bias. The technique is capable of providing switching frequency up to the megahertz range. Appropriate fusing elements are also depicted in FIG. 3.

Exemplary component values and/or designations for the circuit of FIG. 3 are as follows for a compact fluorescent lamp rated at 28 watts with a d.c. bus voltage of at least 120 volts:

| | |
|---|---|
| Capacitors 24, 30 | 22 micro-farads |
| Inductor 37 | 1 milli-henry |

-continued

| | |
|---|---|
| Capacitor 42 | 1500 pico-farads |
| Capacitor 56 | 0.0022 micro-farads |
| Capacitor 44 | 0.1 micro-farads |
| Capacitor 46 | 1500 pico-farads |
| Capacitor 86 | 0.1 micro-farads |
| Resistors 94, 96 | 75K ohms |
| Resistors 100, 104 | 700 ohms |
| Capacitor 107 | .001 micro-farads |
| Resistor 108 | 3.3K ohms |
| Resistor 112 | 5.1 ohms |
| Resistor 132 | 1.5M ohms |
| Resistor 134 | 200K ohms |
| Resistor 136 | 30K ohms |
| Resistor 138 | 10K ohms |
| Capacitor 144 | 0.1 micro-farads |
| Capacitor 146 | 0.22 micro-farads |
| Resistor 148 | 3M ohms |
| Resistor 154 | 300K ohms |
| Resistor 156 | 240K ohms |
| Capacitor 158 | 0.01 micro-farads |
| Resistor 166 | 150K ohms |
| Resistor 168 | 7.5K ohms |
| Resistor 170 | 8K ohms |
| Resistor 172 | 1K ohms |
| Capacitor 174 | 0.001 micro-farads |
| Capacitors 176, 178 | 390 pico-farads |
| Capacitor 180 | 10 micro-farads |
| Resistor 105 | 20K ohms |
| Resistor 200 | 5.1 ohms |
| Inductor 202 | 2.5 milli-henries |
| Capacitor 204 | 0.1 micro-farads |
| Resistor 206 | 330 ohms |
| Resistors 222, 224 | 75K ohms |
| Resistor 226 | 100 ohms |
| Capacitor 228 | 0.1 micro-farads |
| Capacitor 230 | 22 micro-farads |
| Capacitor 106 | 0.1 micro-farads |

In addition, MOSFET 32 is sold under the designation IRF310, MOSFET 34 under designation IRF9310, transistors 162 and 164 under designation FMB3946. Diodes 98, 102, 116, 118, 150, 182, and 184 are sold under designation 1N4148, and diodes 20, 22, 26 and 28 under designation RGL41J.

While the invention has been described with respect to specific embodiments by way of illustration, many modifications and changes will occur to those skilled in the art. It is therefore, to be understood that the appended claims are intended to cover all such modifications and changes which fall within the true spirit and scope of the invention.

What is claimed is:

1. A dimming ballast circuit designed to use a phase dimmer signal to control output of a fluorescent lamp, the dimming ballast circuit comprising:

a controller integrated chip (IC) having an internal operational amplifier with a non-inverting input tied to a steady state voltage and with an inverting input tied to a floating ground, and a Class D output, the controller integrated chip configured in said floating ground arrangement, and configured to generate a drive signal from the phase dimmer signal;

a switching network which receives a drive signal from the controller IC for operating the switching network, to control operation of the fluorescent lamp;

a load circuit including the fluorescent lamp, connected to a series configured resonant inductor and resonant capacitor;

a resonant feedback circuit including at least two capacitors, connected from said resonant inductor to said phase dimmer signal input; and a capacitor connected from a positive DC bus back to a node at a junction between first and second diodes.

2. The dimming ballast circuit of claim 1 further including:

a level shifter designed to receive the phase dimmer signal from the input, and to shift the received phase dimmer signal from a level of the reference ground to a level of the floating ground.

3. The dimming ballast circuit of claim 2 further including a current sensor comprising a load current sensing resistor.

4. A dimming ballast circuit designed to use a phase dimmer signal to control output of a fluorescent lamp, the dimming ballast circuit comprising:

a controller integrated chip (IC) having an internal operational amplifier with a non-inverting input tied to a steady state voltage and with an inverting input tied to a floating ground, and a Class D output, the controller integrated chip configured in said floating ground arrangement, and configured to generate a drive signal from the phase dimmer signal;

a switching network which receives a drive signal from the controller IC for operating the switching network, to control operation of the fluorescent lamp;

a load circuit including the fluorescent lamp, connected to a series configured resonant inductor and resonant capacitor;

a resonant feedback circuit including at least two capacitors, connected from said resonant inductor to said phase dimmer signal input;

a capacitor connected from a positive DC bus back to a node at a junction between first and second diodes;

a level shifter designed to receive the phase dimmer signal from the input, and to shift the received phase dimmer signal from a level of the reference ground to a level of the floating ground;

a current sensor comprising a load current sensing resistor; and, a pair of diodes connected in parallel, and in opposite directions, across the current sensing resistor.

5. The dimming ballast circuit of claim 3 further including, a feedback signal generated from the current sensor.

6. The dimming ballast circuit according to claim 1, wherein the switching network includes a pair of switches.

7. The dimming ballast circuit according to claim 6, wherein the pair of switches are configured as a common source complementary pair of transistors.

8. The dimming ballast circuit according to claim 7, wherein gates of the common source complementary pair of transistors are driven from a single drive signal.

9. The dimming ballast circuit according to claim 1, wherein the fluorescent lamp is driven by a pulse width modulated signal.

10. The dimming ballast circuit according to claim 1, wherein the switching frequency of the ballast circuit is 100 K Hz or greater.

11. The dimming ballast circuit according to claim 1 wherein the phase dimmer signal is a chopped input voltage, which is shifted from circuit ground to floating ground.

12. A dimming ballast circuit designed to receive a phase dimmer signal to control output of a fluorescent lamp, the dimming ballast comprising:

an input network configured to receive input from the phase dimmer and generate the phase dimmer signal comprising:

a first and a second diode connected in series to receive the positive going input from a first phase dimmer connection to the first diode;

a first capacitor connected between the remaining end of the second diode and a second phase dimmer connection;

a third and a fourth diode connected in series to receive the negative going input from the first phase dimmer connection to the third diode; and, a second capacitor connected between the remaining end of the fourth diode and the second phase dimmer connection, the first and second capacitors thereby connected in a series voltage doubler configuration, and the junction between the fourth diode and second capacitor comprising a common ground;

a controller integrated chip (IC) having an internal operational amplifier with a non-inverting input tied to a level shifted voltage and with an inverting input tied to a floating ground, and a Class D output, the controller integrated chip configured in said floating ground arrangement;

a coupling capacitor connected at one end to the output of the integrated chip;

a complementary pair of power switches, wherein the gates of the switches receive the output of the integrated chip through a second end of the coupling capacitor;

a resistor connected to the second end of the coupling capacitor, and to the floating ground;

a switching current sensor which senses current of the switching network and generates a feedback signal;

a level shifter designed to receive the phase dimmer signal from the input, and to shift the received phase dimmer signal from a level of the reference ground to a level of the floating ground forming a level shifted signal;

an operational amplifier which amplifies an error difference between the level shifted signal of the level shifter and the feedback signal from the current sensor, such that the amplified difference is used to control the output frequency of said controller integrated chip;

a resonant network configured to receive the output from the switching network; and, a resonant feedback circuit configured to return a fraction of the energy stored in said resonant network to the input network, said resonant feedback circuit comprising:

a third capacitor connected between the resonant network and a first resonant feedback node comprising the junction between the third and fourth diodes;

a fourth capacitor connected between the junction of the second diode with the first capacitor and a second resonant feedback node comprising the junction between the first and second diodes; and, a fifth capacitor connected between the first and second resonant feedback nodes.

13. The dimming ballast circuit according to claim 12, wherein the complementary a pair of switches are configured as a common source complementary pair of transistors.

14. The dimming ballast circuit according to claim 13, wherein gates of the common source complementary pair of transistors are driven from a single drive signal.

15. The dimming ballast circuit according to claim 12, wherein the fluorescent lamp is driven by a pulse width modulated signal.

16. The dimming ballast circuit according to claim 12, wherein the switching frequency of the ballast circuit is 100 K Hz or greater.

17. The dimming ballast circuit according to claim 12, wherein the phase dimmer signal is a chopped input voltage, which is shifted from circuit ground to floating ground.

18. A method of controlling an output supplied to a fluorescent lamp by a ballast comprising:

supplying a square wave signal to a resonant input network of the ballast;

configuring an integrated control chip of the ballast with a floating ground;

sensing an average switching signal of a switching network of the ballast;

forming a feedback signal based on the sensed average switching current;

feeding the input signal to a level shifter circuit of the ballast;

generating a level shifted signal from the input signal fed to the level shifting circuit;

amplifying an error difference between the level shifted signal and the feedback signal;

supplying the amplified difference signal to a compensation network which controls an effective timing resistance input to the operational amplifier thereby controlling the output frequency of the operational amplifier;

energizing a resonant load circuit via the switching network;

feeding a fraction of the resonant load circuit energy back to the input signal via coupling by at least two capacitors;

feeding a fraction of a DC voltage back to the input signal and resonant circuit via a coupling capacitor; and energizing the fluorescent lamp via the resonant load network.

19. The method according to claim 18, wherein dimming is accomplished by fixed frequency current mode controlled pulse width modulated signals.

20. The dimming ballast circuit of claim 4 further including, a feedback signal generated from the current sensor.

* * * * *